US005173715A

United States Patent [19]

Rodal et al.

[11] Patent Number: 5,173,715

[45] Date of Patent: Dec. 22, 1992

[54] ANTENNA WITH CURVED DIPOLE ELEMENTS

[75] Inventors: Eric B. Rodal, Cupertino; Michael C. Detro, Los Gatos; David R. Gildea, Menlo Park; James M. Janky, Sunnyvale, all of Calif.

[73] Assignee: Trimble Navigation, Sunnyvale, Calif.

[21] Appl. No.: 714,192

[22] Filed: Jun. 12, 1991

Related U.S. Application Data

[63] Continuation-in-part of Ser. No. 445,754, Dec. 4, 1989, abandoned.

[51] Int. Cl.[5] ..... H01Q 9/16; H01Q 21/26

[52] U.S. Cl. ..... 343/795; 343/797; 343/817; 343/830

[58] Field of Search ..... 343/795, 797, 793, 802, 343/806, 808, 817, 818, 829, 833, 846, 830

[56] References Cited

U.S. PATENT DOCUMENTS 4,864,318 9/1989 Iwasaki et al. ..... 343/795

4,878,062 10/1989 Craven et al. ..... 343/797

*Primary Examiner*—Michael G. Wimer

*Attorney, Agent, or Firm*—William E. Pelton

[57] ABSTRACT

An antenna comprises a base plate forming a ground plane, a coaxial feed serving as a mast connected to the base plate and extending along an axis that is normal to the ground plane, and two orthogonal dipoles each formed of two elements. Each dipole element has a first end connected to and supported by the mast at a first location spaced apart from the ground plane by a predetermined distance and a second end closer to the ground plane and exhibits a curvature in a plane containing the mast.

16 Claims, 9 Drawing Sheets

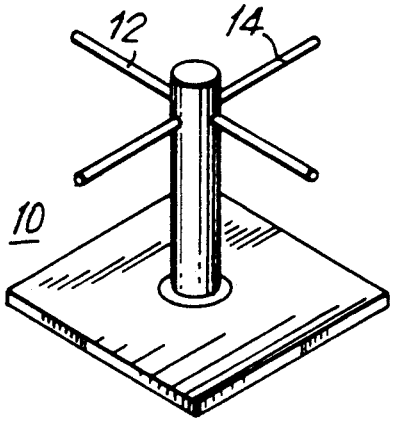
FIG. 1A
PRIOR ART
FIG. 1B
PRIOR ART
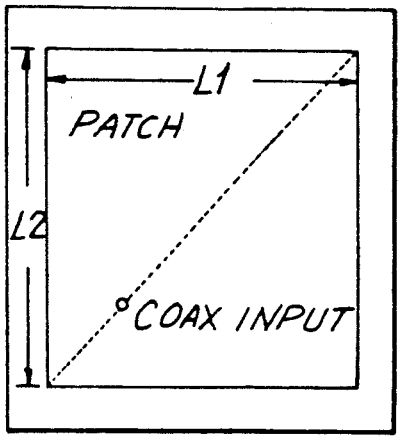
L1>L2
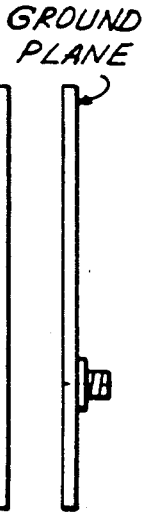
FIG. 1C
PRIOR ART
FIG. 1D
PRIOR ART
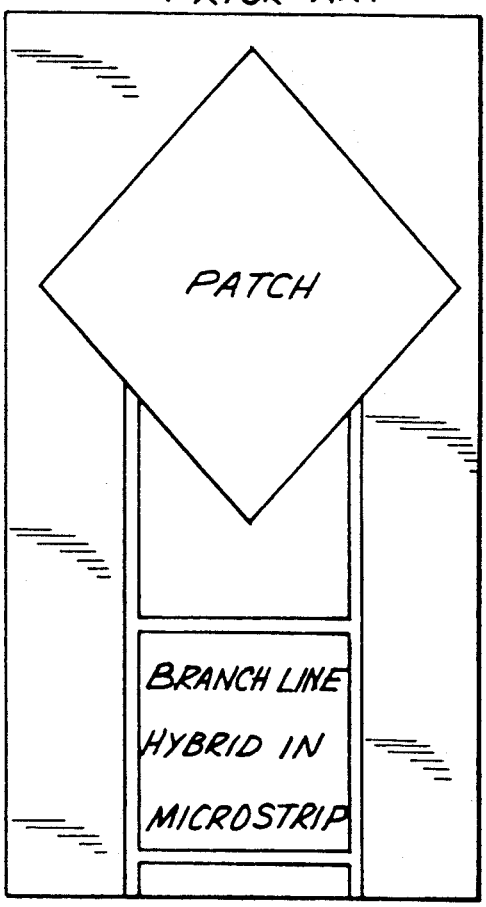
RHC INPUT

ANTENNA WITH CURVED DIPOLE ELEMENTS

This is a continuation-in-part of application Ser. No. 445,754, filed Dec. 4, 1989, now abandoned.

BACKGROUND OF THE INVENTION

1. Field of the Invention

This invention relates to antennas and, more particularly, to a novel, inexpensive, and highly-effective antenna that has nearly constant gain over a hemisphere of solid angle so that it is essentially omnidirectional for antennas located near the surface of the earth. It is sensitive over a wide bandwidth and, compared to other inexpensive antennas, such as turnstile and patch antennas, has an improved impedance match and voltage standing wave ratio (VSWR).

2. Description of the Prior Art

For certain radio transmissions, circular polarization (CP) is desirable. CP is a special case of elliptic polarization in which the horizontal and vertical (orthogonal) components are of equal magnitude and exactly 90 degrees out of phase. Most polarized signals are not perfectly circular, but have some degree of ellipticity. References herein to CP include elliptic polarization in every possible range.

Turnstile, patch, and other types of relatively inexpensive antennas are known that are semi-omnidirectional—i.e., have nearly uniform gain over the celestial hemisphere seen from a point relatively near the surface of the earth—and have respective impedances that can be matched to those of the respective circuits in which they are used. Turnstile antennas are disclosed in a book entitled "Antennas" by John D. Kraus, McGraw-Hill Book Company, second edition, 1988, pages 726–731. A typical conventional turnstile antenna 10 (FIG. 1A of the appended drawing) comprises two dipoles 12 and 14 lying in a plane. Such an antenna is referred to hereinafter as a "planar turnstile." If the dipoles 12 and 14 are properly related to each other and properly driven and the plane defined by the dipoles 12 and 14 is horizontal, the turnstile antenna formed thereby can transmit or receive CP radiation very well at the zenith, which is directly above the antenna, but less well as the angle from the zenith increases.

Another well-known semi-omnidirectional antenna is commonly referred to as a "patch," or planar microstrip antenna. These antennas are also disclosed in the Kraus publication mentioned above (pages 745–749). With this type of antenna, the reduction in the vertical E-field component is even more pronounced, resulting in a severe loss of axial ratio for circularly-polarized signals in the plane of the horizon. A typical microstrip patch antenna is shown in FIGS. 1B, 1C and 1D.

An example of this effect is shown in FIG. 2. In this figure, where the angle is defined by a line from the zenith Z to the antenna 10 and another line from the antenna 10 to a point 16 displaced from the zenith, the component of the E vector in the vertical direction is reduced; and where the angle is 90°—that is, where the angle is defined by a line from the zenith to the antenna 10 and another line from the antenna 10 to a point 18 on the horizon—, the vertical component of the E vector disappears entirely in the case of the patch and nearly so in the case of the turnstile, so that the radiation is no longer circularly polarized. Thus a conventional patch antenna and to a lesser extent a conventional turnstile antenna mounted with its base plane horizontal to achieve hemispherical omnidirectionality does not effectively radiate or receive circularly-polarized radiation to or from a region lying in a direction 90° from the zenith. As FIG. 2 shows, the vertical component of the E vector decreases to nearly zero in this region. As the angle with respect to the zenith increases, the axial ratio deteriorates markedly, so that the conventional patch and turnstile are reduced to functioning essentially as linearly-polarized antennas.

In some applications, this loss of axial ratio (or reduction from circular polarization to linear) can mean a significant loss in system performance. For example, in the case where a signal from a navigation satellite is incident at a very low elevation angle above the horizon (80° or more of off-axis angle from the zenith) on a receiver mounted on a marine vehicle, there are likely to be significant multi-path reflections from the surface of the water. When the receiving antenna is able to receive only a single, horizontally-polarized signal, it is likely that interference due to the multiple paths will induce severe fading of the signal, resulting in a loss of information. With an antenna that has good circular polarization (CP), however, the degree of fading is significantly reduced, since it is much harder to cancel out both the vertical and horizontal components with precisely the right 90-degree phase shift between the two signals. In other words, good CP vastly alleviates the problems of low look-angle reception.

Conventional patch and turnstile antennas moreover do not provide uniform gain over a solid angle of 180° of celestial arc. Essentially constant azimuthal gain in the plane of the horizon is easily achieved by using two pairs of dipole elements arranged at right angles to each other. However, such an antenna provides more gain in a direction normal to the ground plane than in a direction parallel to the ground plane. This is a disadvantage particularly on moving vehicles (boats, for example) that exhibit roll and pitch in addition to yaw and translation and that need to transmit o receive omnidirectionally over the celestial hemisphere.

For example, consider a conventional patch or turnstile antenna mounted on a boat that is moored in quiet waters or is in a yard or dry dock. For best omnidirectional transmission or reception over the celestial hemisphere, such an antenna will be mounted with its ground plane parallel to the horizon and its mast extending in a direction normal to the plane of the horizon. The gain of the antenna will then be as shown in curve A of FIG. 3: namely, it will range from a typical maximum value at the zenith, shown in FIG. 3 as +5 decibels relative to isotropics (dBi), to a greatly reduced value on the horizon, shown in FIG. 3 as about −5 dBi.

Let it be assumed that this is satisfactory for reception of signals from, say, a navigation satellite that is anywhere above the horizon. Even on that assumption, reception of signals from a navigation satellite that is low above the horizon may be unsatisfactory at sea, where the boat is subject to roll and pitch. For example, suppose that the satellite is 90° off the starboard bow and low above the horizon while the boat rolls to port. The ground plane of the antenna, which is fixed relative to the boat, will also roll to port, thereby correspondingly reorienting the curves of FIG. 3 so that the antenna gain will fall from the −5 dBi it provides when the boat is level (curve A, which relates to a conventional antenna) to a value less than that, which may be insufficient for adequate transmission or reception.

The situation is made worse when two boats communicate with each other using conventional semi- omnidirectional turnstile antennas. From time to time they will roll and pitch in such a way that the antenna masts tilt away from each other. In that case, the curves of FIG. 3 relating to the transmitting antenna will be rotated, say, clockwise, while the curves for the receiving antenna will be rotated counterclockwise. Thus a signal that is weaker because of the roll and pitch of one boat has to be detected by an antenna that is less sensitive because of the roll and pitch of the other boat.

Another problem with conventional patch antennas is that they are narrow-bandwidth devices that must be carefully tuned to achieve satisfactory operation at the desired frequency. This increases the complexity and cost of the impedance-matching tuning that is necessary to compensate for variations in materials, etc. A primary factor in getting a good SNR is the noise figure of the preamplifier. The antenna is usually tuned to get the best noise figure for nominal preamplifier impedance. But if the antenna has a narrow band, it is hard to guarantee that its impedance will be close to the nominal value at the correct frequency.

Another problem with conventional turnstile antennas is that separate mechanical and electrical structures are provided, thereby leading to undesirable complexity and unnecessary cost. In particular, the mast (mechanical structure) supporting the dipole elements and the driving balun (electrical structure) are physically separate, as disclosed for example in a patent to Counselman et al. U.S. Pat. No. 4,647,942.

Various attempts have been made to overcome the problems of conventional turnstile antennas noted above. The most notable is a drooping dipole arrangement disclosed by a patent to Woodward et al. U.S. Pat. No. 4,062,019. This device has radiating elements attached to mast at a 45-degree angle to the mast. The dipole elements droop down from their point of attachment in a straight line. The radiating element is thus at a 45-degree angle to both the plane of the horizon and a vertical plane through the mast. This inclination of the radiating elements makes it possible for the two orthogonal components of the electric field to exist over a much wider range of solid angle. In the case of planar patch and turnstile antennas (see FIGS. 1A-1D), the vertical component of E field in the direction of the horizontal plane (the ground plane) is significantly reduced as explained above.

So the Woodward et al. drooping turnstile antenna addresses some of the needs of a small, simple, semi-omni/CP antenna. Its most important characteristic is that the dipole elements are all straight lines, inclined at a 45+/−5-degree angle to the mast of the turnstile. In addition, the characteristic impedance of the drooping dipole is a fixed number that must be accounted for in the impedance matching network. (Naturally it is variable over a certain range dictated by dipole physical dimensions, spacing with respect to the ground plane, etc., but the range of variation is small.)

Other prior art of interest includes the following U.S. Pat. No.: 1,988,434, 2,110,159, 2,976,534, 3,919,710, and 3,922,683. However, no art heretofore developed discloses an inexpensive antenna that has essentially constant gain over a hemisphere of solid angle so that it is semi-omnidirectional, has excellent CP near the horizon, and is sensitive over a wide bandwidth and has an excellent VSWR.

OBJECTS AND SUMMARY OF THE INVENTION

An object of the invention is to remedy the problems outlined above. In particular, an object of the invention is to provide a novel, inexpensive, and highly-effective antenna that has essentially constant gain over a hemisphere of solid angle so that it is semi-omnidirectional.

Another object of the invention is to provide an antenna with excellent CP over a wide range of look angles, especially near the horizon.

Another object of the invention is to provide an antenna that is sensitive over a wide bandwidth and has an excellent impedance match and VSWR.

Another object of the invention is to provide an antenna that requires no tuning or is easily tunable without the aid of special circuit elements such as impedance-matching transformers, which are unavoidably lossy.

The foregoing and other objects are attained in accordance with the invention by the provision of an antenna comprising: base plate means forming a ground plane; mast means connected to the base plate means and extending along an axis that is normal to the ground plane; and a pair of dipole elements each having a first end connected to and supported by the mast means at a first location spaced apart from the ground plane by a predetermined distance and a second end closer to the ground plane; each of the dipole elements exhibiting a curvature in a plane containing the mast means.

In accordance an independent aspect of the invention, there is provided an antenna comprising: base plate means forming a ground plane XY defined by axes X and Y that intersect each other at right angles at an origin; mast means connected to the base plate means and extending along an axis Z that is normal to the ground plane at the origin; and a pair of dipole elements extending in a plane XZ defined by the axes X and Z; each of the dipole elements having a first end connected to and supported by the mast means at a first location spaced apart from the ground plane by a predetermined distance and a second end closer to the ground plane; each of the dipole elements exhibiting a curvature in the XZ plane; and the curvature having a first derivative that is continuous and has a constant sign.

In accordance with another independent aspect of the invention, there is provided an antenna comprising: base plate means forming a ground plane; mast means connected to the base plate means and extending along an axis that is normal to the ground plane; and two pairs of orthogonally-related dipole elements connected to and supported by the mast means; wherein the mast means is formed as a coaxial cable feed.

DESCRIPTION OF THE DRAWING

A better understanding of the objects, features and advantages of the invention can be gained from a consideration of the following detailed description of the preferred embodiments thereof, taken in conjunction with the appended figures of the drawing, wherein:

FIG. 1A is a perspective view of a conventional planar turnstile antenna;

FIG. 1B is a plan view of a conventional patch antenna illustrating a shape that is nearly but not quite square (L1>L2) and a coaxial input located on a diagonal of the patch offset from the center thereof;

FIG. 1C is a side view of the structure of FIG. 1B;

FIG. 1D is a plan view illustrating the connection of the patch of FIGS. 1B and 1C to a branch line hybrid in a microstrip;

Figure 5:
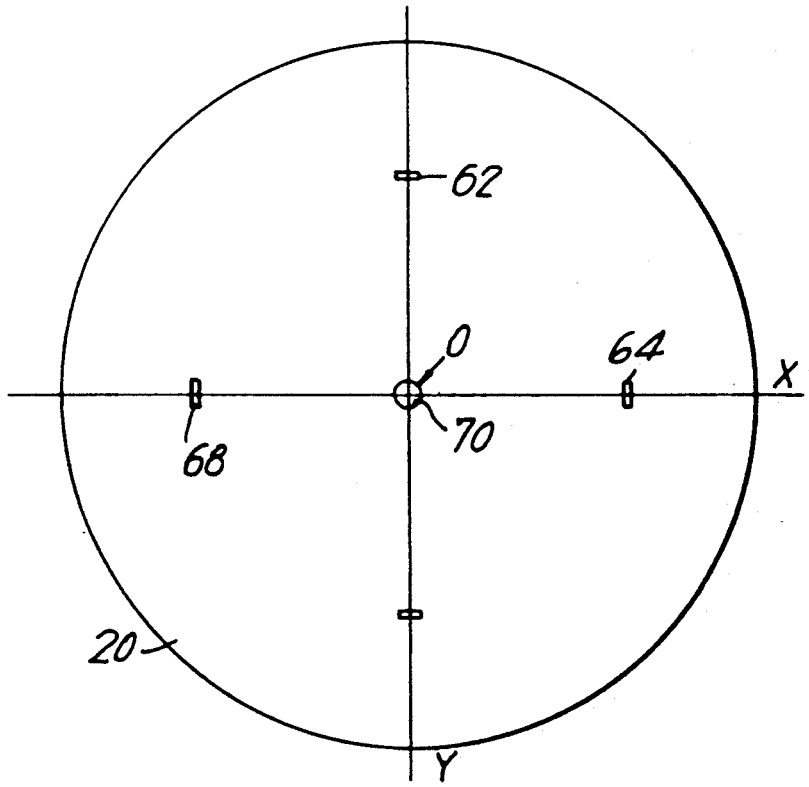
Figure 6:
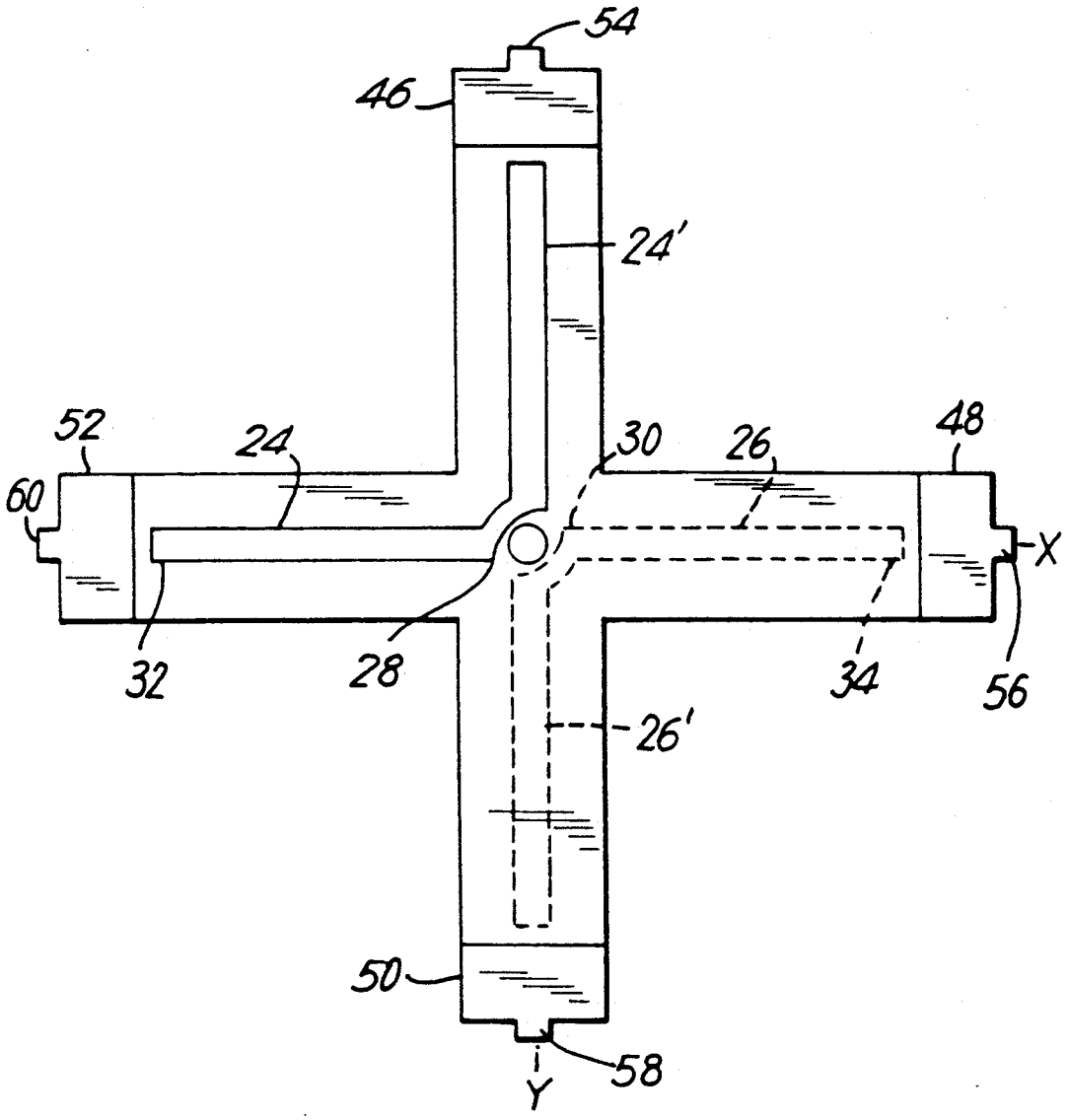
Figure 7:
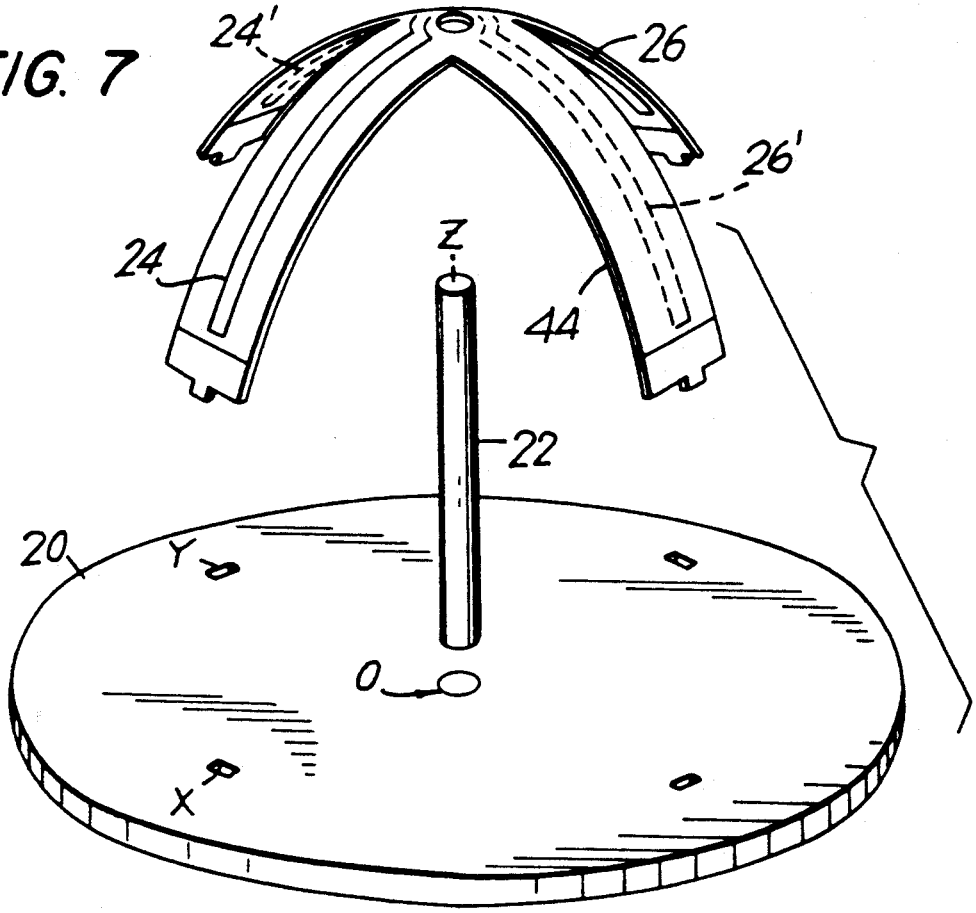
Figure 8:
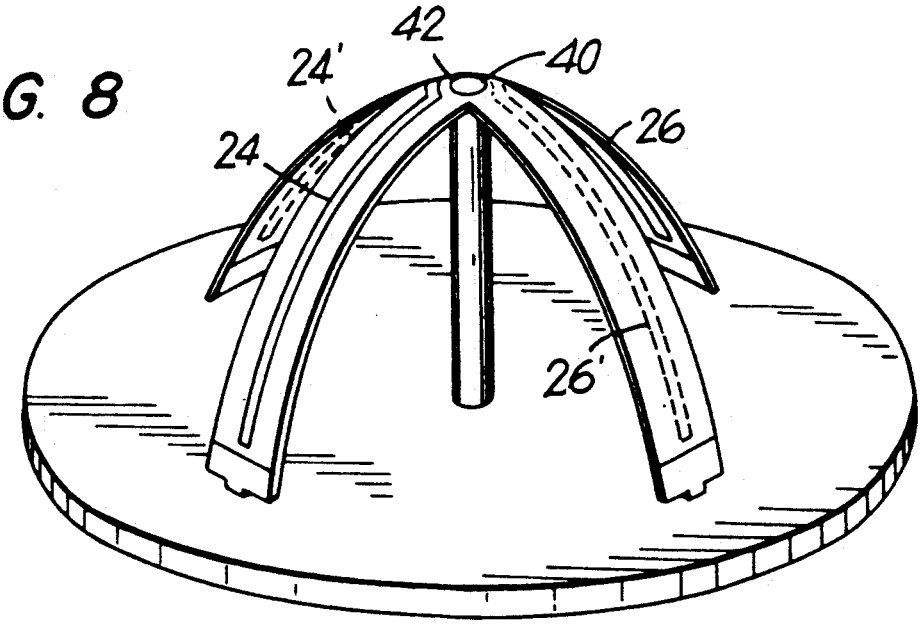
Figure 8A:
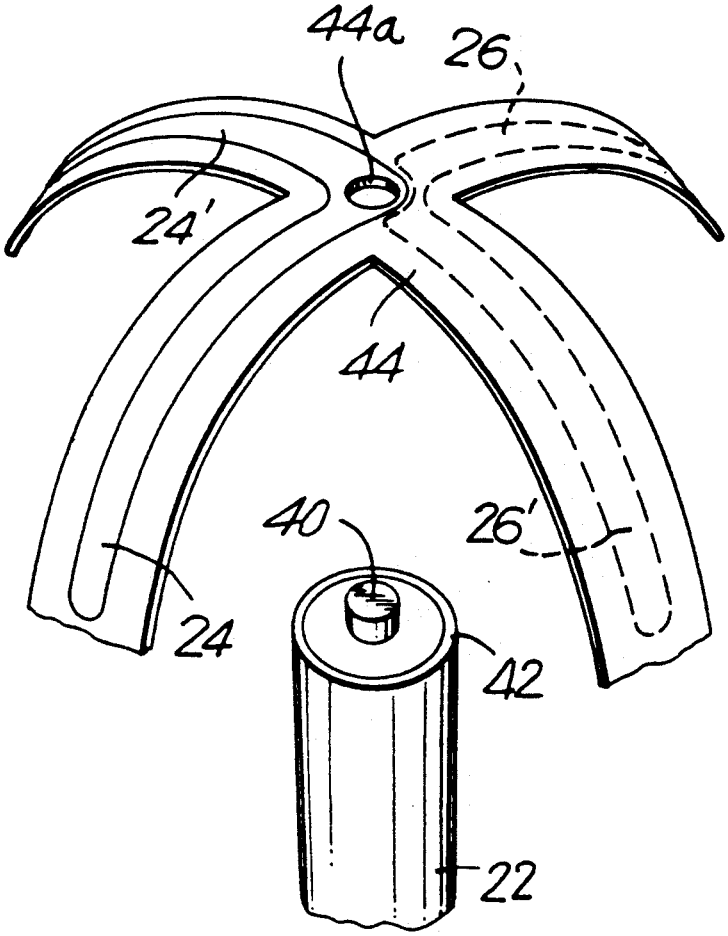
Figure 9:
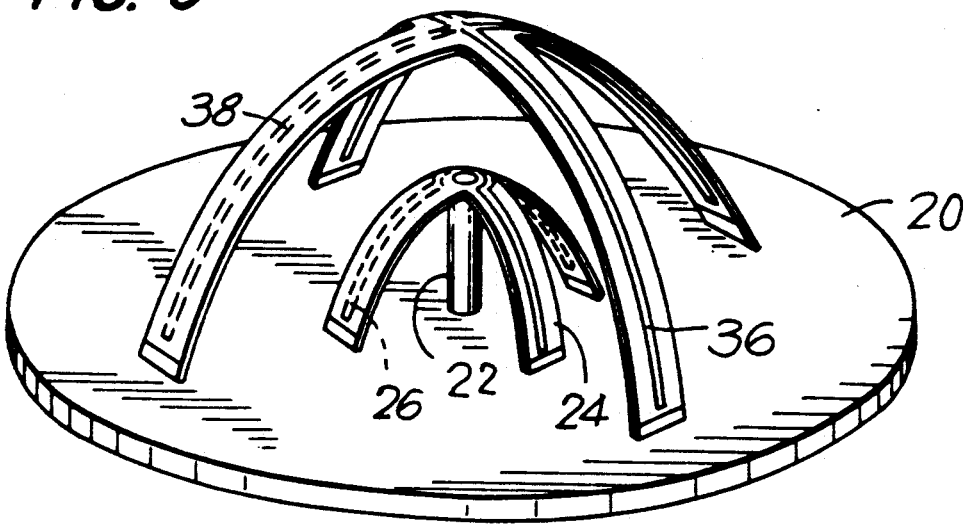
Figure 10:
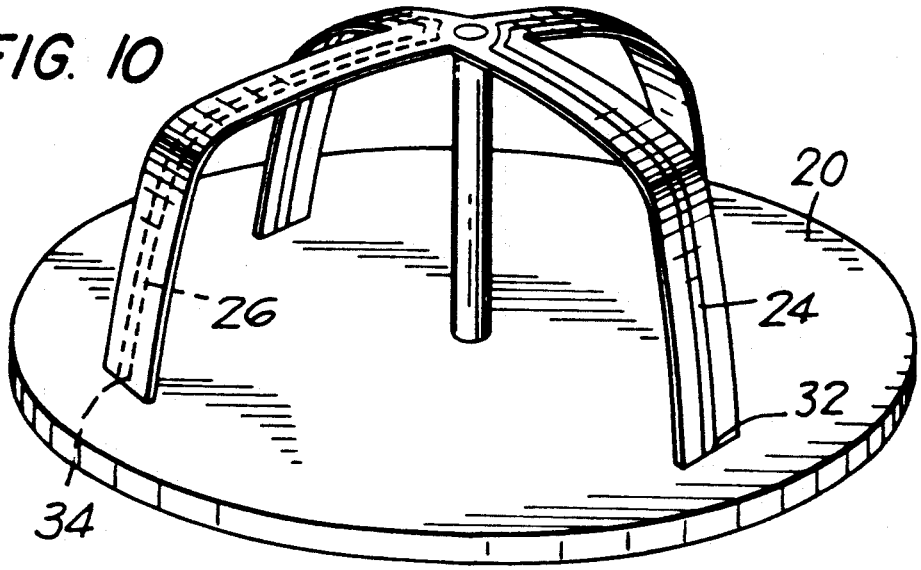
Figure 11:
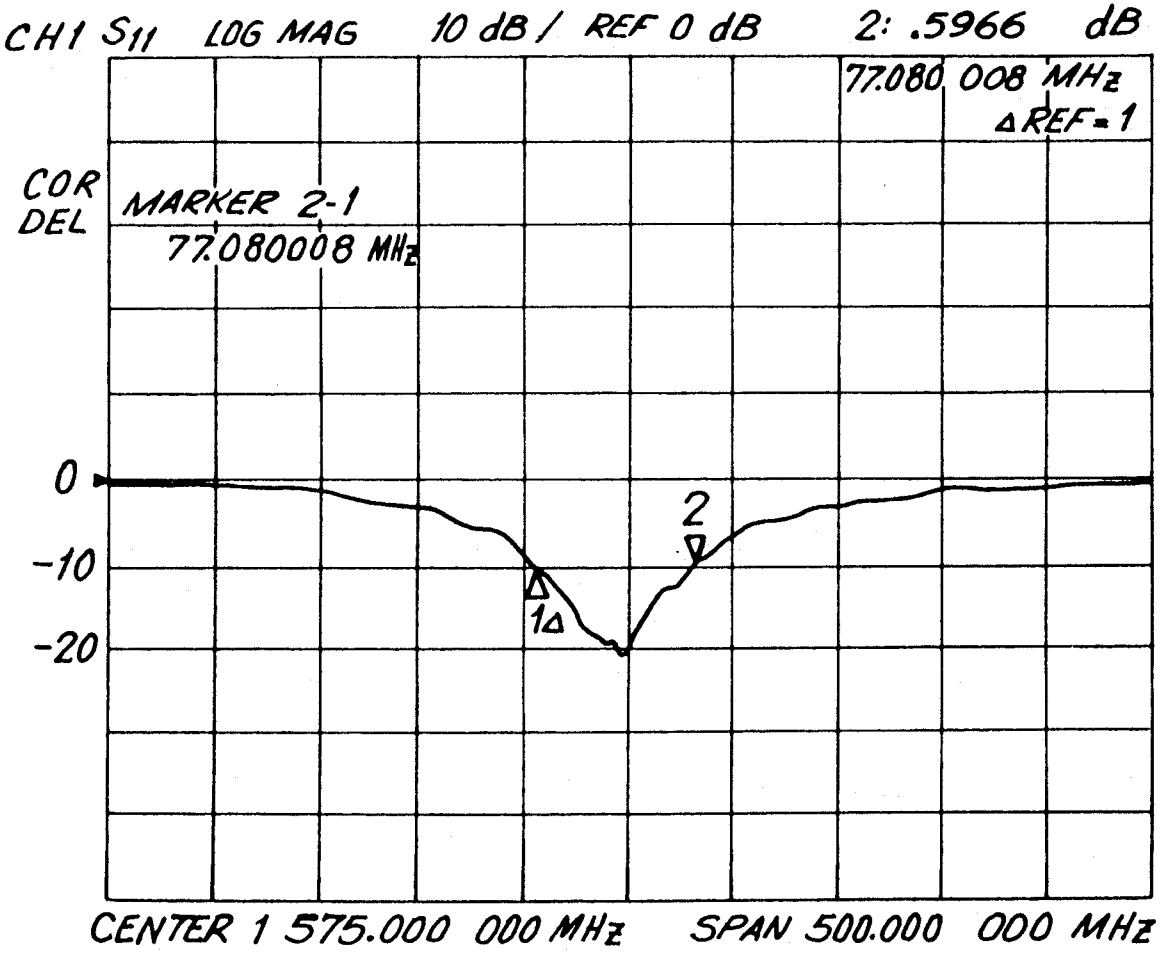
FIG. 11 PRIOR ART
Figure 12:
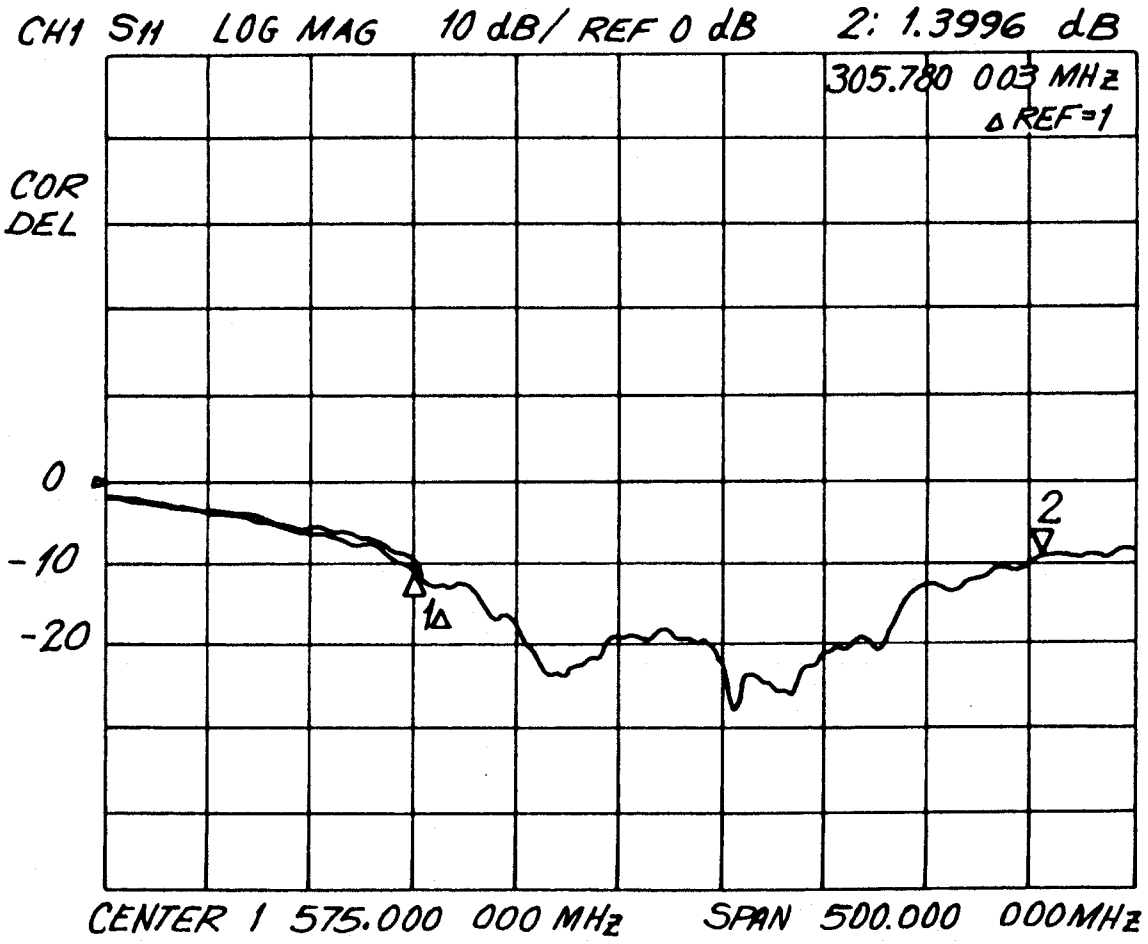

which equation represents a subset of all possible curves in accordance with the invention;

FIG. 5 is a top plan view of a base plate that defines a ground plane in an antenna constructed in accordance with the invention;

FIG. 6 is a top plan view of a printed circuit board that supports two pairs of dipole elements and is used in constructing an antenna in accordance with the invention;

FIG. 7 is an exploded perspective view showing the assembly of the structures of FIGS. 5 and 6 together with a coaxial cable that serves as a mast in order to form an antenna in accordance with the invention;

FIG. 8 is a perspective view of an assembled antenna in accordance with the invention FIG. 8A is an exploded view, partially cut away, of the antenna structure of FIG. 8;

FIG. 9 is a perspective view of the antenna of FIG. 8 with the addition of passive dipole elements forming parasitic-coupled resonators in accordance with the invention;

FIG. 10 is a view corresponding to FIG. 8 but showing the replacement of the quarter-wave dipole elements of FIG. 8 with half-wave dipole elements connected to the ground plane;

FIG. 11 is a graph of the return loss in VSWR as a function of frequency in the case of a conventional patch antenna; and FIG. 12 is a graph of the return loss in VSWR as a function of frequency in the case of an antenna constructed in accordance with the invention.

DESCRIPTION OF THE PREFERRED EMBODIMENTS

FIG. 8 shows a preferred embodiment of an antenna constructed in accordance with the invention. It comprises a base plate 20 forming a ground plane, a mast 22 connected to the base plate 20 and extending along an axis that is normal to the ground plane, and a pair of dipole elements 24 and 26 (the latter hidden in FIG. 8 but visible for example in FIG. 6) together forming a first dipole and each having a first end 28 or 30 connected to and supported by the mast 22 at a first location spaced apart from the ground plane by a predetermined distance (equal to the height of the mast 22) and a second end 32 or 34 closer to the ground plane (i.e., touching the ground plane (FIG. 10) or spaced apart from the ground plane (FIG. 8) by a distance less than the predetermined distance).

In accordance with the invention, each of the dipole elements 24 and 26 exhibits a curvature in a plane containing the mast 22.

In order to obtain circular polarization and an antenna gain that is essentially constant azimuthally with respect to the ground plane, an additional pair of dipole elements 24' and 26' is employed, and the dipole elements of the additional pair are curved as described above. In other words, the mast 22 lies along the intersection of the planes defined by the curved dipole elements 24, 26 and 24', 26'.

Figure 4:
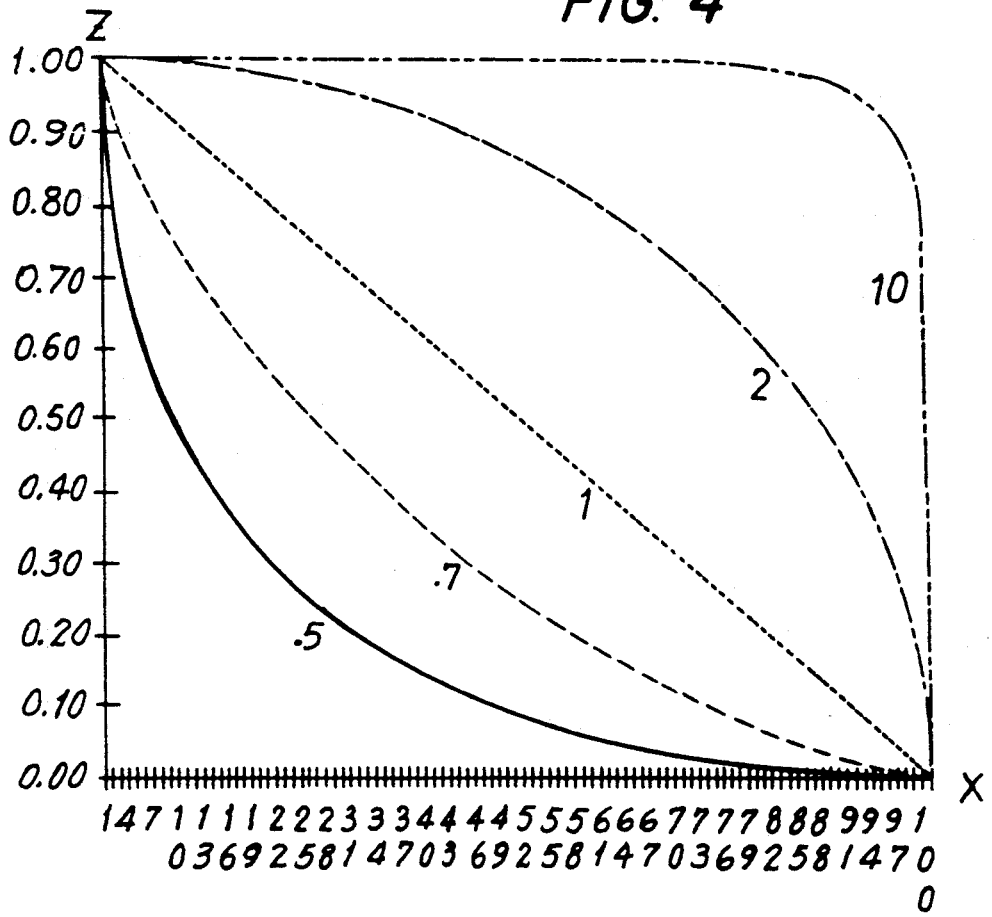
FIG. 4 is a diagram showing different curvatures in accordance with the invention of a dipole element with n as a parameter in the equation $$\frac{x^n}{a} + \frac{z^n}{b} = 1,$$

The curvature of the dipole elements may be either convex, as indicated for example in FIG. 8 and by curves n=2 and n=10 in FIG. 4, or concave, as indicated by curves n=0.5 and n=0.7 in FIG. 4. Convexity and concavity are defined with reference to the perspective for example of FIG. 8, which shows the antenna as it might appear when held in the hand.

As FIG. 9 shows, the invention preferably further comprises a pair of elongate parasitic elements 36 and 38 respectively cooperating with the pairs of dipoles 24, 26 and 24', 26' and each exhibiting a curvature in a plane containing the mast 22. The parasitic elements 36 and 38 may lie respectively in the planes of the dipole elements 24, 26 and 24', 26' or may be rotated about the axis defined by the mast 20 so as to lie in different planes from the planes of the dipole elements 24, 26 and 24' and 26'. The parasitic elements 36 and 38 may but need not be respectively generally parallel to the dipole elements 24, 26 and 24', 26'.

The base plate 20 forms a ground plane XY (FIG. 5) defined by axes X and Y that intersect each other at right angles at an origin O. The mast 22 is connected to the base plate 20 at the origin O and extends along an axis Z (FIG. 7) that is normal to the ground plane XY at the origin O. The dipole elements 24, 26 extend in a plane XZ defined by the axes X and Z. The dipole elements 24', 26' extend in a plane YZ defined by the axes Y and Z. Each of the dipole elements 24, 26 and 24', 26' exhibits a curvature in the XZ plane or YZ plane. This curvature has a first derivative that is continuous and has a constant sign. In the case of the dipole 24, 26, the curvature is given by $$\frac{x^n}{a} + \frac{z^n}{b} = 1$$

where x is distance from the origin O along the X axis, z is distance from the origin O along the Z axis, a and b are arbitrary constants, and n is a parameter such that $0<n<\infty$ and $n\neq 1$. In the case of the dipole pair 24', 26', the curvature is given by $$\frac{y^n}{a} + \frac{z^n}{b} = 1$$

where y is the distance from the origin O along the Y axis and the other symbols have the same meanings as those set out above.

Moreover, in accordance with the invention, the mast 22 is formed by a coaxial cable feed. As FIG. 8 shows, the center conductor of the coaxial cable feed, for example the conductor 40, is connected to two of the dipole elements that meet at right angles, for example the elements 24 and 24' (the latter being hidden in FIG. 8), and the other conductor of the coaxial cable feed, for example the outer conductor 42, is connected to the other dipole elements, for example, the elements 26 (hidden in FIG. 8) and 26'. The ratio of dipole lengths $D_1/D_2$ is approximately equal to 1.17. The dipole lengths are different in order to provide circularly polarized waves with a single feed.

The dipole elements 24, 26 and 24', 26' are preferably formed as part of a printed circuit board. A fiberglass board 44 (FIG. 6) 0.01 inches in thickness and shaped as a cross has the dipole elements 24, 26 and 24', 26' formed thereon. Adjacent orthogonal dipole elements are printed on opposite sides of the thin cross. This facilitates making connections to the coax/mast. For example, in a preferred embodiment as shown in FIG. 8A, the pair of orthogonal dipole elements 24 and 24' are printed on the top side of the printed circuit board material 44. In this embodiment, the pair of elements 24 and 24' may be connected to the center conductor 40 of the coaxial feed mast 22. One such connection may be accomplished where the printed circuit board 44 is provided with a bore 44*a* through which the center conductor 40 of the feed mast passes to engage the printed circuit conductors forming the dipole elements 24 and 24'. Under such circumstances, the other pair of dipole elements 26 and 26' may be printed on the underside of the printed circuit board material 44 and adapted to be connected to the outer conductor 42 upon assembly of the antenna structure. The connection between the printed circuit conductors forming the dipole elements 26 and 26' may be by direct contact with the upper surface of the outer conductor 42 of the feed mast 22. The connections between the dipole elements 24, 24', to the center conductor 40 of the feed mast 22 and between the dipole elements 26, 26' to the outer conductor 42 of the feed mast 22 may be secured by appropriate soldering.

At their outer ends, the dipole elements may but need not terminate short of conductive tabs 46, 48, 50 and 52 of the same width as the crossed arms of the fiberglass board 44. The tabs 46, 48, 50 and 52 are formed with projections 54, 56, 58 and 60, that can be inserted respectively through holes 62, 64, 66, 68 formed in the base plate 20 (FIG. 5). The holes 62, 64, 66, 68 are spaced from a center hole 70 for the mast 22 by a distance which is selected relative to the lengths of the arms of the fiberglass board 44 and the height of the mast 22 so that, when the projections 54, 56, 58, 60 are inserted through the holes 62, 64, 66, 68 and the mast 22 is properly positioned, the arms of the fiberglass board 44 and therefore the dipole elements 24, 26 and 24', 26' are automatically given the desired curvature.

Figure 2:
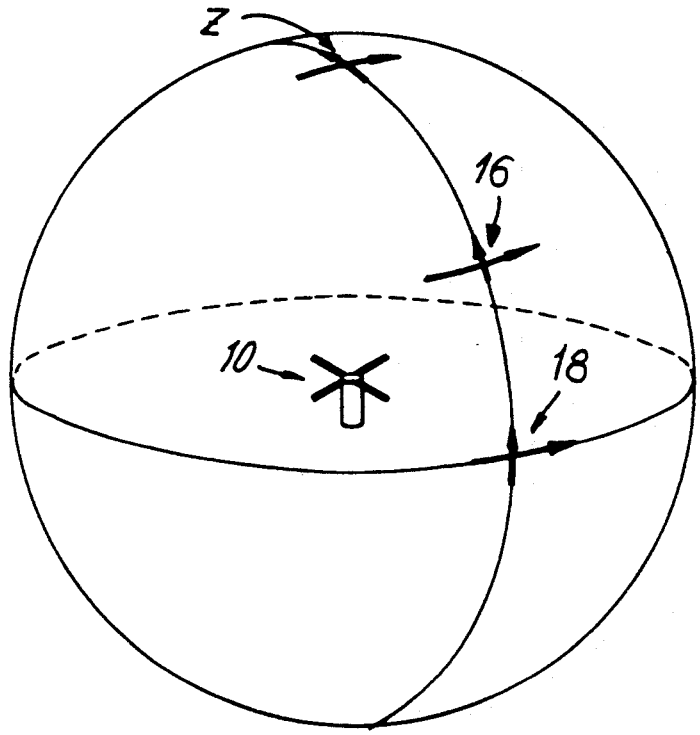
FIG. 2 PRIOR ART
FIG. 2 is a perspective view of a turnstile antenna illustrating its ability to transmit and receive electromagnetic radiation that is circularly polarized as a function of the angle formed by a first line extending from the zenith to the antenna and a second line extending through the antenna in a direction parallel to the direction of propagation of the electromagnetic radiation.
Figure 3:
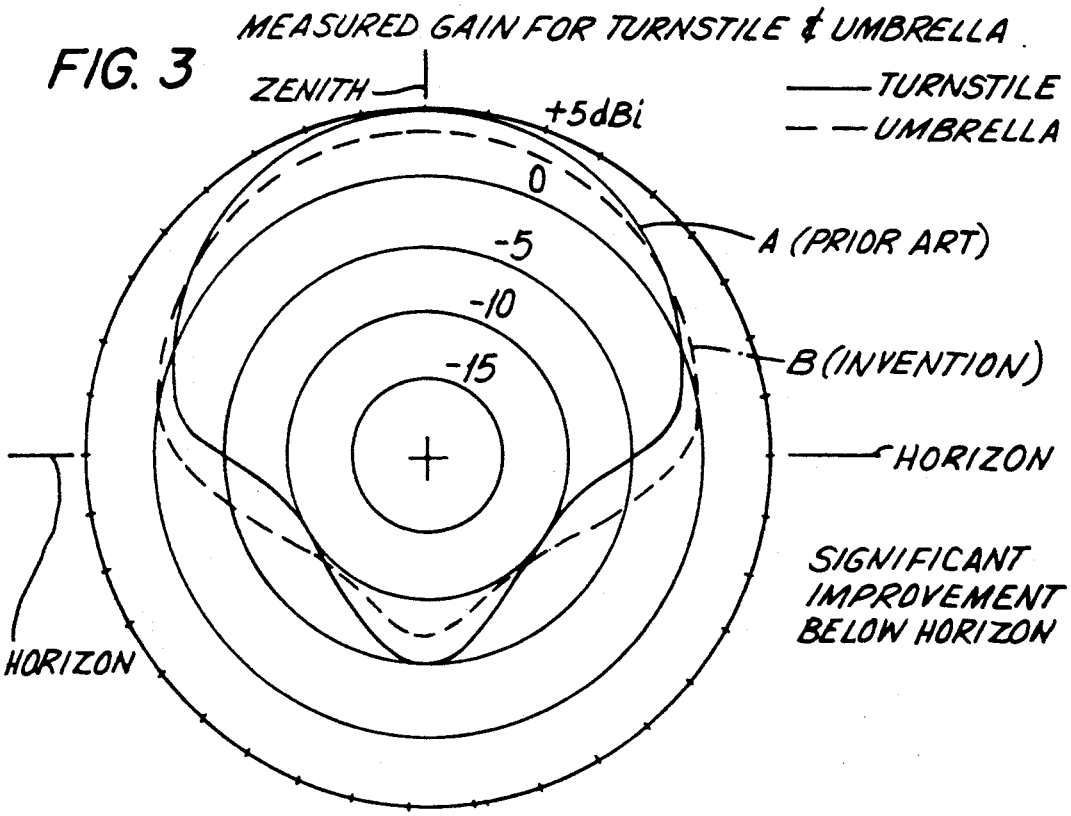
FIG. 3 is a diagrammatic view in elevation showing the antenna gain in dBi as a function of the direction of propagation relative to the horizon (or zenith) in the case of a typical conventional turnstile antenna (curve A) and in the case of an antenna constructed in accordance with the invention (curve B)

FIG. 7 is an exploded view showing the mast 22, the fiberglass board 44, and the base plate 20 in a position about to be assembled, and FIG. 8 shows the final assembly. FIG. 9 shows the addition of the parasitic resonators 36 and 38, which modify and in general enhance the curve B shown in FIG. 3. As curve B shows, the antenna gain is about +3 dBi at the zenith and about −2 dBi at the horizon. While some gain is sacrificed at the zenith as compared to curve A of a conventional antenna, this is of no consequence, since at the zenith the incoming signal from a navigation satellite, for example, experiences the least attenuation and distortion. What is important is that, near the horizon, antenna gain is considerably improved relative to the gain of the conventional turnstile. Moreover, in accordance with the invention, signal gain remains nearly the same even at angles somewhat below the horizon. Thus transmission and reception are not compromised even when a boat or aircraft, etc., on which the antenna is mounted rolls and pitches through a considerable angle.

The direction of the curve (either inward, toward the mast and ground plane or outward, away from the mast and ground plane) alters both the impedance and the radiation pattern. The best arrangement for obtaining good impedance matching, excellent gain pattern and excellent circular polarization (axial ratio) is achieved when the dipole elements are curved in a manner resembling the spokes of an umbrella. The preferred embodiment of the invention may therefore be described as an "umbrella" antenna. Since the curve of each dipole element is within a plane containing the coaxial mast, there is no spiral component, which would make the shape of the dipole element three-dimensional. In the equations set out above and in FIG. 3, when $n=1$, we have the familiar, degenerate case of a straight-line dipole element, described in the Woodward et al. patent mentioned above. As n increases in value, the curvature becomes convex (pushed outward toward the viewer). When n equals 2 and a and b are equal, we have a circle, and the preferred umbrella dipole element appears. As n increases, the curve begins to look more like a rectangle. When n is less than 1, the dipole element begins to droop downward and becomes concave (pushed inward, away from the viewer), as shown by the examples $n=0.7$ and $n=0.5$. The allowable range for n is any value greater than 0 (except $n=1$, the condition that results in linear dipole elements). The preferred range is less, and, in accordance with the best-known mode of practicing the invention, $n=2$.

When a and b are equal and $n=2$, the curves are circular, as noted above; when a and b are unequal and $n=2$, the curves are elliptical.

It is not necessary for the dipole elements to touch the base plate forming the ground plane (FIG. 10) but only come near it (e.g., FIG. 8). The mast to which the dipole elements are attached can touch and penetrate the base plate in order to provide the support needed and provide a connection from the mast/coax to the rest of the transmitter/receiver (not shown).

The curvature of the dipole elements in such a manner as to have a continuous first derivative with a constant sign affords two advantages previously unavailable to the designer. The first is that the characteristic impedance of the dipole and therefore of the entire assembly can be made to cover a very wide range. The second is that the radiation pattern of the dipole and therefore of the entire assembly, when used as an array to form an antenna of practical value, changes considerably because of the varying spatial relation of the dipole to the ground plane.

The antenna can be connected to a transmitter, a receiver, or both. When connected to both, it is through a combining junction. In the case of the receiver, it is important to be able to achieve the exact impedance match necessary to get the best overall receiver performance as determined by a system figure of merit, normally given by the ratio of antenna gain G to system noise temperature T or G/T. It can be shown that the detected SNR is directly proportional to this commonly-employed figure of merit. Often it is difficult to obtain the desired impedance levels directly from the antenna elements. Instead, various impedance-matching techniques are employed, using various types of transmission lines or transformers. These impedance-matching circuit elements often introduce resistive losses that decrease the effective gain G of the antenna. So it is significant that the impedance level of the antenna of the invention can be varied over a wide range. The preferred embodiment of the invention achieves a desirable impedance level and maintains it over a wide frequency range.

Similarly, when the antenna is being used as a transmitter, it is equally important that the antenna impedance be matched to the source impedance for maximum power transfer. So regardless of use the ability to vary the impedance levels is a major advantage not easily obtainable with comparable turnstile configurations.

When the curvature of the dipole elements approximates that of a circle (n=2), the resultant characteristic impedance is brought into a region where it is optimum for achieving the best noise figure from the receiver amplifier, and therefore the best receiver figure of merit G/T. The tuning and impedance matching can be accomplished without use of lossy transformers or additional circuit elements. The shape of the dipole elements moreover makes it relatively easy to fabricate a usable antenna.

In the preferred embodiment, the mast or support structure for the dipole elements is made up of the coaxial feed line, a semi-rigid outer tubing commonly used in the communications industry and having a standard 0.141-inch diameter. The mast actually functions as a balun, or balanced-to-unbalanced transformer, which is needed in order properly to convey energy to or from the dipole elements. It is approximately a quarter-wavelength (open-circuit case) or a halfwavelength (short-circuit case) in height above the ground plane and thereby performs the balanced-to-unbalanced conversion process.

Circular polarization is obtained with the umbrella antenna by the method described in the Woodward et al. patent. The dipole elements in the XZ (or YZ) plane are made to be slightly shorter than they would be if they were truly resonant at the desired operating frequency. The dipole elements in the YZ (or XZ) plane ar made to be slightly longer. This separation of resonant frequencies provides the mechanism for obtaining the 90-degree phase shift needed to form a circularly-polarized signal. At the operating frequency, the phase of the longer dipole leads the phase of the shorter dipole. By adjusting the lengths, the desired 90-degree shift can be obtained. This method is well known and is used extensively in patch and other antenna designs.

At the feed point, i.e., at the top end of the mast, there are four dipole conductive elements forming two orthogonal dipole pairs. One adjacent pair is printed on the top side of the dielectric cross and the other is printed on the bottom side (FIG. 6). The inner end (i.e., the end near the mast) of a dipole element of one dipole pair is connected to the inner end of a dipole element of the other pair on the top side of the support dielectric, and the two elements thus connected are connected to, say, the center conductor of the coax forming the support mast. Similarly, the inner ends of the two remaining dipole elements on the bottom side of the support dielectric are connected to each other and to the other (outer) conductor of the coax forming the mast. Thus adjacent orthogonal pairs of dipole elements are driven in a balanced manner, exactly as they must be in order properly to excite the dipoles. The drawings illustrate structure that produces left-hand circular polarization. By reversing the connections between adjacent orthogonal dipole elements, the sense of the polarization can be reversed (from left to right).

The type of dipole used for the radiating element can be either open-circuited, as in the preferred embodiment as shown in FIGS. 6–9 of the drawing, or short-circuited, as shown in FIG. 10. In the short-circuited embodiment of the invention, the end not connected to the mast-balun is connected to ground wavelength long instead of a quarter-wavelength for the open-circuited case.

Parasitic resonators are used in the so-called Yagi antennas (for reception of television signals) to provide a change of pattern from that of the basic dipole. These parasitic resonators often have the same general shape and nearly the same size as the active dipole. In a similar manner, it is possible to alter the far-field pattern of the basic antenna in accordance with the invention having two pairs of dipoles by providing a set of parasitic resonators whose general shape mimics that of the active elements. These parasitic resonators can be arranged either to enhance the gain on-axis, at the local zenith, or to "squash" the pattern and provide an increase in gain in the plane of the horizon, at the expense of gain in the zenith direction. Further, these parasitic elements can be aligned in any azimuthal direction in the XY plane.

The equations set out above by no means represent the only curves that can be used to define the shape of the dipole elements. The equations are very good, however, for representing near-right-angle bends, as n approaches infinity.

The two halves of each dipole need not be of the same length. There may be some applications where, say, the left half should be longer or shorter than the right half or should depart from mirror-image symmetry in some other way.

Moreover, the equations define the shape of only one-half of a complete dipole pair: i.e., the shape of only a single resonant element. If the same equation is applied to both elements of a dipole pair, the derivative undergoes a sign change at $x=0$ or $y=0$.

One of the most important benefits of the new antenna design in comparison to a planar patch antenna is that the frequency bandwidth over which a very good impedance match can be obtained is much larger. For example, a typical planar patch might exhibit a voltage standing wave ratio (VSWR) vs. frequency plot as shown in FIG. 11, for an antenna operating at a frequency of 1575 MHz. By contrast, the umbrella antenna exhibits a VSWR vs. frequency plot as shown in FIG. 12. The acceptable VSWR limit is arbitrarily chosen to be 1.92, or a return loss of 10 dB. The bandwidth improvement, delimited by points 1 and 2 in each graph, is over 400 percent. This is typical of what can be expected from this new class of dipole element. Because of the new degree of freedom the curved dipole element provides, it is much easier to obtain satisfactory performance.

The improvement in VSWR vs. bandwidth is very important from the manufacturability standpoint. It means that less effort in the tuneup procedure is needed to obtain a satisfactory level of performance, and therefore the manufacturing cost can be less than in the case of a planar patch. This is a benefit to manufacturers and consumers.

Thus there is provided in accordance with the invention a novel and highly-effective antenna that has nearly constant gain over a hemisphere of solid angle so that it is essentially omnidirectional and circularly polarized, that is sensitive over a wide bandwidth, and that has an improved impedance match and VSWR. In the foregoing disclosure and in the appended claims terms such as "normal," "orthogonal," "right angles," and "parallel" relating one structure to another or to the environment are employed. These terms are intended to mean "generally," "roughly," or "substantially" normal, orthogonal, etc., and to allow for any degree of tolerance that does not prelude the substantial attainment of the objects and benefits of the invention. Many modifications of the preferred embodiments of the invention disclosed herein will readily occur to those skilled in the art, and the invention is limited only by the appended claims.

We claim:

1. An antenna comprising:

a base plate member defining a ground plane element;

mast means for conducting electrical feed current, said mast means being attached to the base plate member and extending along an axis that is normal to the ground plane element;

means for conducting electrical feed current to said mast means;

a first pair of antenna elements defining a dipole, each of said antenna elements being a single substantially flat conductive strip formed on one surface only of a first thin flexible portion of dielectric material thereby to define a conductive printed circuit on said one surface of said first portion of dielectric material and being conductively coupled to the mast means at a first end, each of said first ends and said first thin flexible portion of dielectric material being supported by the mast means at a first location space apart from the ground plane element by a predetermined distance, and each of said antenna elements having a second end substantially closer to the ground plane element than to said first end, no portion of said ground plane element being closer to said first location than said predetermined distance;

each of the printed circuit antenna elements together with said first thin flexible portion of dielectric material exhibiting a smooth and continuous first curvature throughout its length in a plane containing the mast means;

a first pair of conductive tabs each electrically connected to said ground plane element, one of said first pair of conductive tabs being connected to said first thin flexible portion of dielectric material in closely spaced-apart relation to said second end of one of said first pair of antenna elements and the other of said first pair of conductive tabs being connected to said first thin flexible portion of dielectric material in closely spaced apart relation to said second end of the other of said first pair of antenna elements;

a second pair of antenna elements defining a dipole, each of said second pair of antenna elements being a single substantially flat conductive strip formed on one surface only of a second thin flexible portion of dielectric material thereby to define a conductive printed circuit on said one surface of said second portion of dielectric material and being conductively coupled to the mast means at a first end, said first end of each of said second pair of antenna elements and said second thin flexible portion of dielectric material being supported by the mast means adjacent to the first location, each of said antenna elements of said second pair having a second end substantially closer to the ground plane element than to said first end;

each of the printed circuit antenna elements of the second pair together with said second thin flexible portion of dielectric material exhibiting a smooth and continuous second curvature in a plane that contains the mast means; and a second pair of conductive tabs each electrically connected to said ground plane element, one of said second pair of conductive tabs being connected to said second thin flexible portion of dielectric material in closely spaced-apart relation to said second end of one of said second pair of antenna elements and the other of said second pair of conductive tabs being connected to said second thin flexible portion of dielectric material in closely spaced-apart relation to said second end of the other of said second pair of antenna elements.

2. The antenna according to claim 1, wherein said curvature of said first and second pairs of antenna elements is convex.

3. The antenna according to claim 1, wherein said curvature of said first and second pairs of antenna elements is concave.

4. The antenna according to claim 1, further comprising a pair of elongate parasitic antenna elements each of said parasitic antenna elements respectively cooperating with a corresponding one of said first pair of antenna elements and each exhibiting a curvature in a plane containing the mast means and said corresponding one of said first pair of antenna elements.

5. The antenna according to claim 4, wherein each of said parasitic antenna elements is respectively generally parallel to said corresponding one of said first pair of antenna elements.

6. The antenna according to claim 1, wherein each of said first pair of conductive tabs is formed with a first projection and said ground plane element is formed with a first projection and said ground plane element is formed with a first pair of holes respectively positioned to receive said first projections so that when said first projections are respectively inserted through said first pair of holes and said mast means is properly positioned, said first thin portion of dielectric material and therefore said first pair of antenna elements are automatically given said first curvature.

7. The antenna according to claim 1, wherein the curvature of said first pair of antenna elements is given by $$\frac{x^n}{a} + \frac{z^n}{b} = 1$$

wherein x is the distance from the origin along the X axis, z is distance from the origin along the Z axis, a and b are arbitrary constants, and n is a parameter such that $$0 < n < \infty \text{ and } n \neq 1.$$

8. The antenna according to claim 7, wherein the curvature of said second pair of antenna elements is given by $$\frac{y^n}{a} + \frac{z^n}{b} = 1$$

wherein y is distance from the origin along the Y axis.

9. The antenna of claim 1, wherein each of said second pair of conductive tabs is formed with a second projection and said ground plane element is formed with a second pair of holes respectively positioned to receive said second projections so that, when said second projections are respectively inserted through said second pair of holes and said mast means is properly positioned, said second thin portion of dielectric material and therefore said second pair of antenna elements are automatically given said second curvature.

10. The antenna of claim 1, in which in a planar projection of said antenna elements each element of each pair of each such first and second pairs of printed circuit antenna elements is in substantially orthogonal relationship to an element of the other pair of antenna elements.

11. The antenna of claim 1, in which said mast means comprises a center conductor and one element of each pair of antenna elements is electrically connected to said center conductor.

12. The antenna of claim 1, in which said mast means comprises an outer conductor and one element of each pair of printed circuit antenna elements is electrically connected to said outer conductor.

13. The antenna of claim 12, in which one element of each pair of antenna elements is formed on said one surface of said first thin flexible portion of dielectric material and the other element of each pair of antenna elements is formed on a surface of said second thin flexible portion of dielectric material that is opposite said one surface.

14. The antenna of claim 13, in which the elements of each pair of said first and second pairs of antenna elements are out of electrical contact with each other.

15. The antenna of claim 1, in which said first and second thin flexible portions of dielectric material are formed as a single dielectric board in the shape of a cross.

16. The antenna of claim 1, in which said mast means comprises an inner conductor and one element of each pair of printed circuit antenna elements is electrically connected to said inner conductor.

* * * * *